US005868259A

United States Patent [19]

Bielagus

[11] Patent Number: 5,868,259

[45] Date of Patent: Feb. 9, 1999

[54] OVERHEAD DRIVE BAR SCREEN

[75] Inventor: Joseph B. Bielagus, Tualatin, Oreg.

[73] Assignee: Beloit Technologies, Inc., Wilmington, Del.

[21] Appl. No.: 854,028

[22] Filed: May 9, 1997

Related U.S. Application Data

[63] Continuation of Ser. No. 735,311, Oct. 22, 1996, abandoned.

[51] Int. Cl.[6] ..... B07B 1/46

[52] U.S. Cl. ..... 209/674; 209/394

[58] Field of Search ..... 209/674, 679, 209/676, 393–396

[56] References Cited

U.S. PATENT DOCUMENTS

| | | | |
|---|---|---|---|
| 1,606,301 | 11/1926 | Jones . | |
| 2,443,176 | 6/1948 | Banning | 209/395 |
| 5,305,891 | 4/1994 | Bielagus | 209/396 |
| 5,392,930 | 2/1995 | Jones | 209/674 |
| 5,392,931 | 2/1995 | Bielagus | 209/674 |
| 5,476,179 | 12/1995 | Jones et al. | 209/674 |
| 5,560,496 | 10/1996 | Lynn | 209/674 X |

FOREIGN PATENT DOCUMENTS

| | | |
|---|---|---|
| 0259963 | 3/1988 | European Pat. Off. . |
| 5-192642 | 1/1992 | Japan . |
| WO 87/04087 | 7/1987 | WIPO . |
| WO 94 0226 A | 2/1994 | WIPO . |
| WO 95 01918 A | 1/1995 | WIPO . |

*Primary Examiner*—David H. Bollinger
*Attorney, Agent, or Firm*—Lathrop & Clark

[57] ABSTRACT

Two racks of parallel spaced bars are supported for oscillatory motion from overhead drive shafts having eccentric cam surfaces. A first drive shaft is driven by a belt connected to a motor, and a second shaft is connected to the first shaft for synchronized movement by a rigid link. The bars are clamped to bar support beams without the need for bolts to extend through individual bars. The support beams are connected by side frames to the eccentric cam surfaces.

7 Claims, 10 Drawing Sheets

OVERHEAD DRIVE BAR SCREEN

RELATED APPLICATION

This application is a continuation of U.S. patent application Ser. No. 08/735,311 filed Oct. 22, 1996, now abandoned.

FIELD OF THE INVENTION

The present invention relates to apparatus for screening particulate matter such as wood chips and municipal trash in general and relates to bar screen apparatus in particular.

BACKGROUND OF THE INVENTION

Bar screens have proven particularly valuable in sorting materials which have unequal dimensions. Wire or punched screens are typically used to sort materials of a granular nature in which all three dimensions are approximately equal. However, many classes of objects, including two of particular commercial interest, wood chips and municipal or industrial trash, are not readily amenable to separation by conventional screening processes.

In the manufacture of paper, logs are reduced to wood chips by chipping mechanisms, and the chips are cooked with chemicals at elevated pressures and temperatures to remove lignin. The chipping mechanisms produce chips which vary considerably in size and shape. For the cooking process, which is known as digesting, it is desirable that the chips supplied have a uniform thickness in order to achieve optimal yield and quality. Ideally, the supplied chips will allow production of a pulp which contains a low percentage of undigested and/or overtreated fibers. Thus, a means is needed to separate chips on the basis of thickness rather than any other dimension. Bar screens have proven particularly adept at separating materials based on a single dimension such as thickness.

With the rise in the recycling culture, a strong demand for an apparatus for separating municipal and industrial trash into its constituent components for recycling has developed. Conventional separation systems which utilize rotating screen drums have proved ineffective. Municipal trash which typically contains a certain portion of stranded material as well as sheet like materials tend to clog the screens. Further, the tumbling action of screens can result in the breakage of components of the municipal waste stream such as glass bottles thereby increasing the difficulty of recycling them. Bar screens consist of two sets of generally rectangular bars which are joined together in an array of racks. The two sets of bars are interleaved to form a screening bed. The bed consists of the elongated, rectangular bars and the narrow, rectangular spaces between the bars. Material to be sorted is introduced to the surface of the bed and the bars are caused to oscillate so that when one set of bars is going up, the other set is going down. This oscillatory motion tends to tip wood chips or other relatively small planar objects on edge so that those of a given thickness may slide through the gaps between the bars. Alternatively, it has been found when separating office waste paper, that bar screens prove effective in removing extraneous litter from the recovered office paper.

If the limitations of current bar screens could be overcome, the utility of the bar screen, already a valuable tool in the pulp industry and in the recycling industry, would be greatly increased. The first limitation relates to capacity. It is always desirable in a screening apparatus to increase the rate at which materials may be fed over the screen and yet be properly processed by the screen. In the case of bar screens, the existing capability of a given screen is dependent on the total area of the screening bed and more particularly the area of the gaps between the bars through which the separated material must pass. Thus, it would be advantageous to increase both the size of a bar screening unit and the total open area between bars. In current bar screens wherein each set of bars are mounted on shafts which are driven eccentrically, eccentric shafts can only be of a limited length before the bending loads on the shaft cause excessive bearing wear. Further, the eccentric shafts are tied together structurally by the bars of the screen and thus increasing the screen open area by reducing the width of the bars is not practical without some alternative means of tying the eccentric drive shafts together which invariably complicates the construction of the bar screen.

Other areas of possible improvement in bar screens are associated with the desirability of maintaining strict timing between the eccentric drives of each set of bars so that they are maintained at a consistent 180 degrees out of phase relation.

Lastly, reduced maintenance and improved ease of maintenance are always desirable in industrial machinery, particularly those which must function in a dirty environment.

What is needed is a bar screen of increased capacity, improved timing linkages, and lower maintenance costs.

SUMMARY OF THE INVENTION

The bar screen of this invention has a machine frame on which is mounted a motor which drives a first crank shaft. The crank shaft extends perpendicular to the bars of the screening bed and is linked by a rigid link on the end opposite the drive end to a second crank shaft which is in spaced parallel relation to the first crank shaft and likewise extends over the screening bed. Each crank shaft has two pairs of cam surfaces spaced near the shaft ends on either side of the screening bed. Thus the crank shafts have eight cam surfaces with the inner four, which are closest to the screen bed, forming an inner cam set. An outer cam set is formed by the four cam surfaces which are spaced outward of the screen bed. Each pair of inner and outer cam surfaces on each end of the crank shafts supports a single drive frame. The frame is suspended by cam bearings. Thus, on each crank shaft end there is an inner frame and an outer frame which ride on the inner and outer cam surfaces and are driven to oscillate 180 degrees out of phase with respect to each other.

The inner drive frames are on either end of the crank shafts and are thus spaced on either side of the screen bed and are joined by two spaced apart bar support beams. The first set of bars are mounted by depending legs to the bar support beams of the inner drive frames. The inner drive frames are cut away to allow passage of a second set of bar support beams which are parallel to the first set but spaced from them and which join together the outer drive frames. The motor mounted on the machine frame drives the first crank shaft which in turn drives the second crank shaft. The crank shafts in turn cause the inner and outer drive frames to oscillate 180 degrees out of phase. The oscillating drive frames cause the bar support beams and the bars of the first and second rack in turn to oscillate, thus driving the bars comprising the screen bed.

The bars comprising each screen bed have spaced apart depending legs, each of which is clamped into a fixture which mounts the legs to one of two bar support beams which interconnect to drive frames. In order to maximize the open area of the screen bed, the bars are approximately one-quarter inch thick and thus the legs, which are of equal thickness, are clamped and locked by retention bars which interfit with projections on each of the bar legs.

Each bar of each rack of bars has two depending legs which are mounted to oscillating leg support beams. The bar proper extends between the support legs and typically extends beyond the support legs to a section of bar which is cantilevered to one side or the other of the portion of the bar between the support legs. The cantilevered sections of the support bars benefit from being joined together to control the spacing of the bars and to add rigidity to each rack of bars which makes up the bar screen deck. The cantilevered portions of the bars have short depending legs. Where the bars are sufficiently thick, threaded holes are formed extending upwardly from the bottom of the bars, the threaded holes engage bolts which attach an angled bracket to the bottoms of the cantilever legs. For additional stiffness, a triangular spacer bracket extends between each bar and is welded to the angle bracket. Where the bars are too thin to receive a bolt into their bottom surfaces, a hole may be bored through the thickness of the depending cantilever legs. A long threaded rod is then passed through each of the cantilever legs of the rack of bars and through polyurethane spacers which are positioned between the cantilever legs. The threaded rod engages a bolt at each end of the screen rack which may be tightened to clamp and compress the bars in parallel spaced relation.

For ease of assembly, the through thickness holes in the cantilever legs of the bar screen may be replaced with canted slots which receive the threaded rod and the spacers thereon allowing the preassembly of the rod and spacers. The individual bars are then engaged by means of the canted slots between the spacers and the nuts at the end of the threaded rod are tightened to clamp the bars in spaced parallel relation.

It is a feature of the present invention to provide a bar screen which protects the eccentric drive mechanism from contact with the material sorted.

It is another feature of the present invention to provide a bar screen which is adaptable to screen decks of greater width.

It is a further feature of the present invention to provide a bar screen which facilitates the use of bars of thinner gauge.

It is a yet further feature of the present invention to provide a bar screen which can process wood chips or industrial or municipal waste.

It is yet another feature of the present invention to provide a bar screen having lower maintenance costs.

It is a still further feature of the present invention to provide a bar screen wherein the two interleaved racks are kept in fixed oscillatory phase relation.

Further objects, features, and advantages of the invention will be apparent from the following detailed description when taken in conjunction with the accompanying drawings.

DESCRIPTION OF THE PREFERRED EMBODIMENTS

Figure 1:
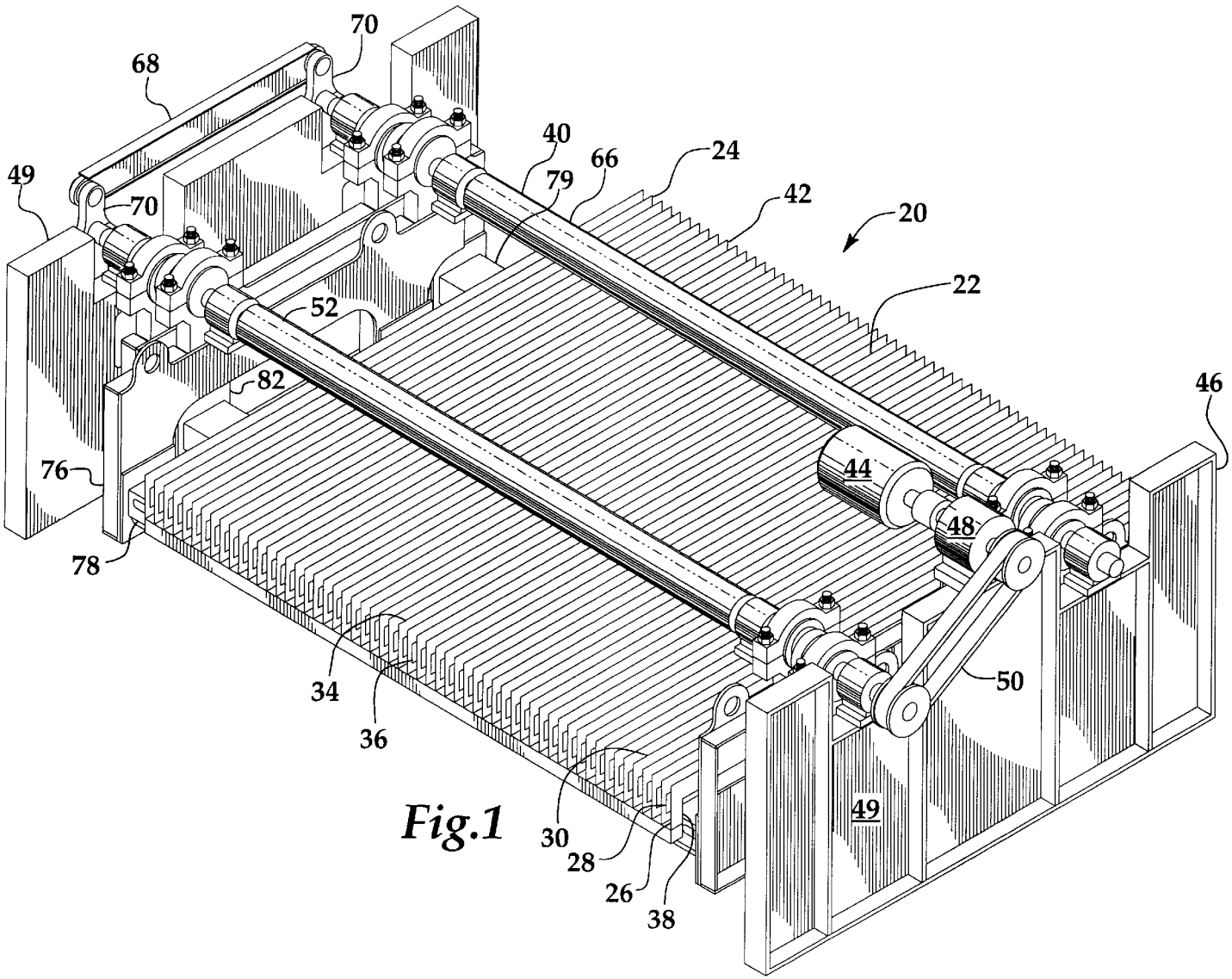
FIG. 1 is an isometric view of the bar screen of this invention with the crank shaft housings removed for clarity.
Figure 2:
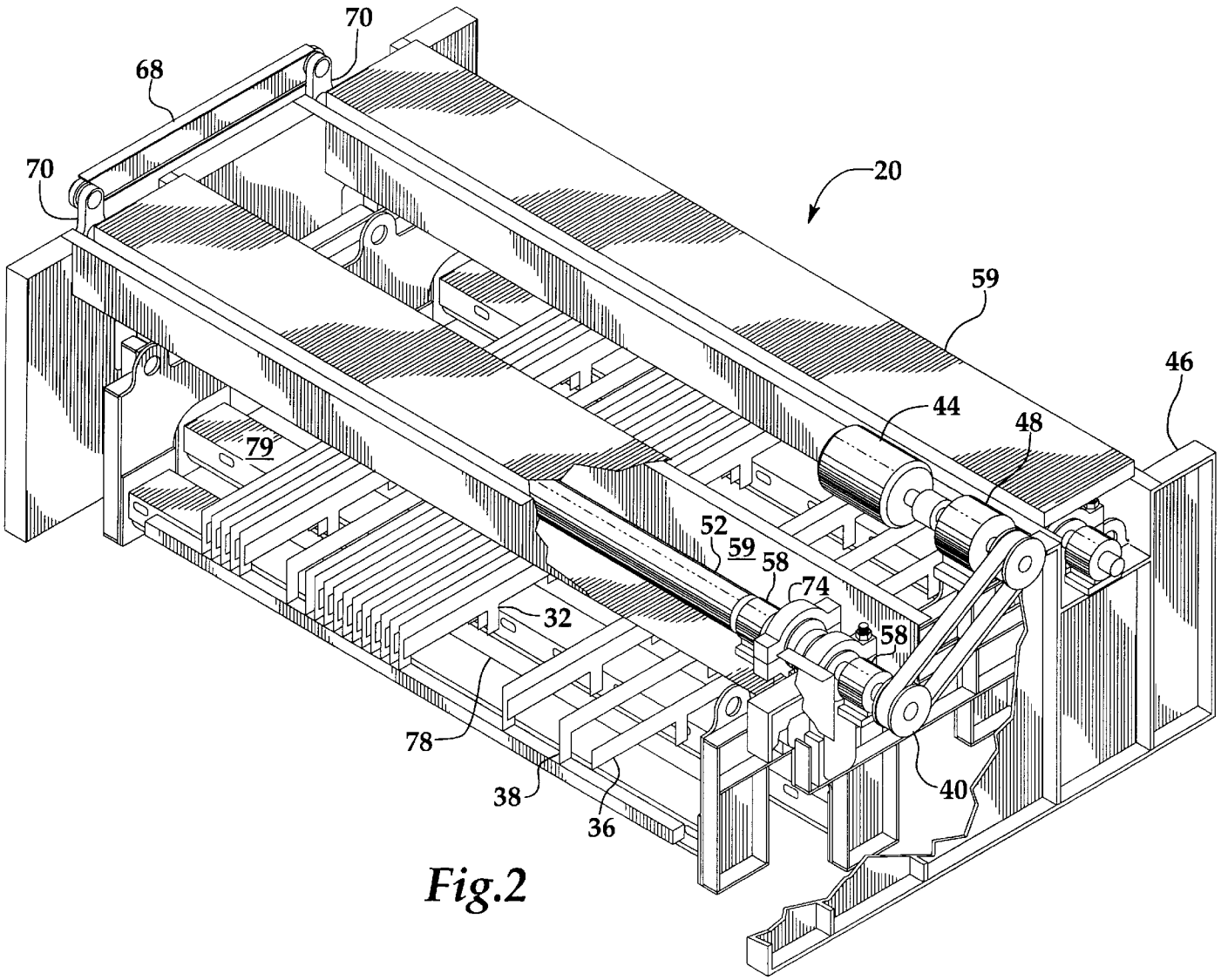
FIG. 2 is an isometric view of the bar screen of FIG. 1 partly cut away.
Figure 3:
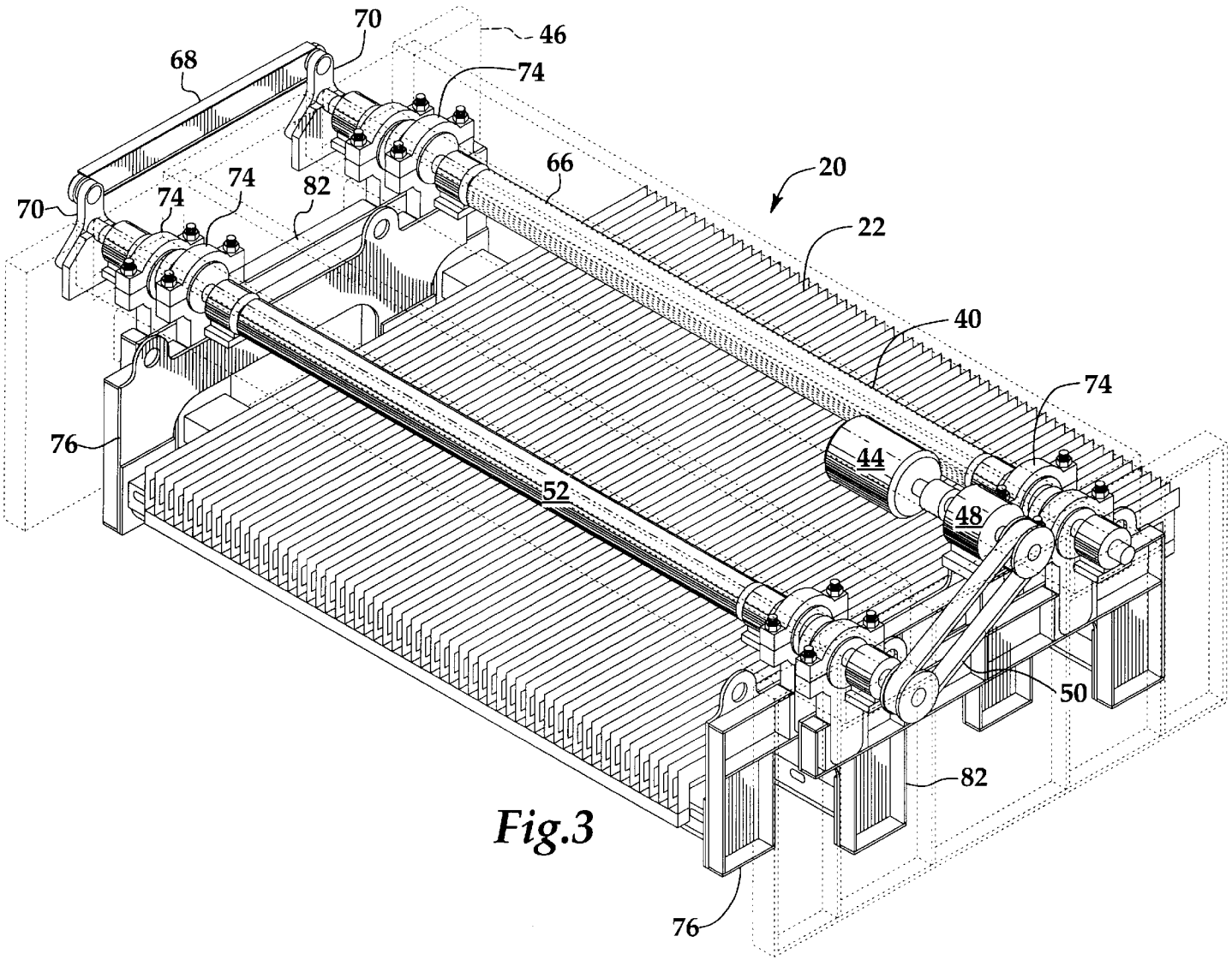
FIG. 3 is an isometric view of the drive train of the bar screen of FIG. 1 with the non-drive portions of the apparatus shown in phantom view.
Figure 4A:
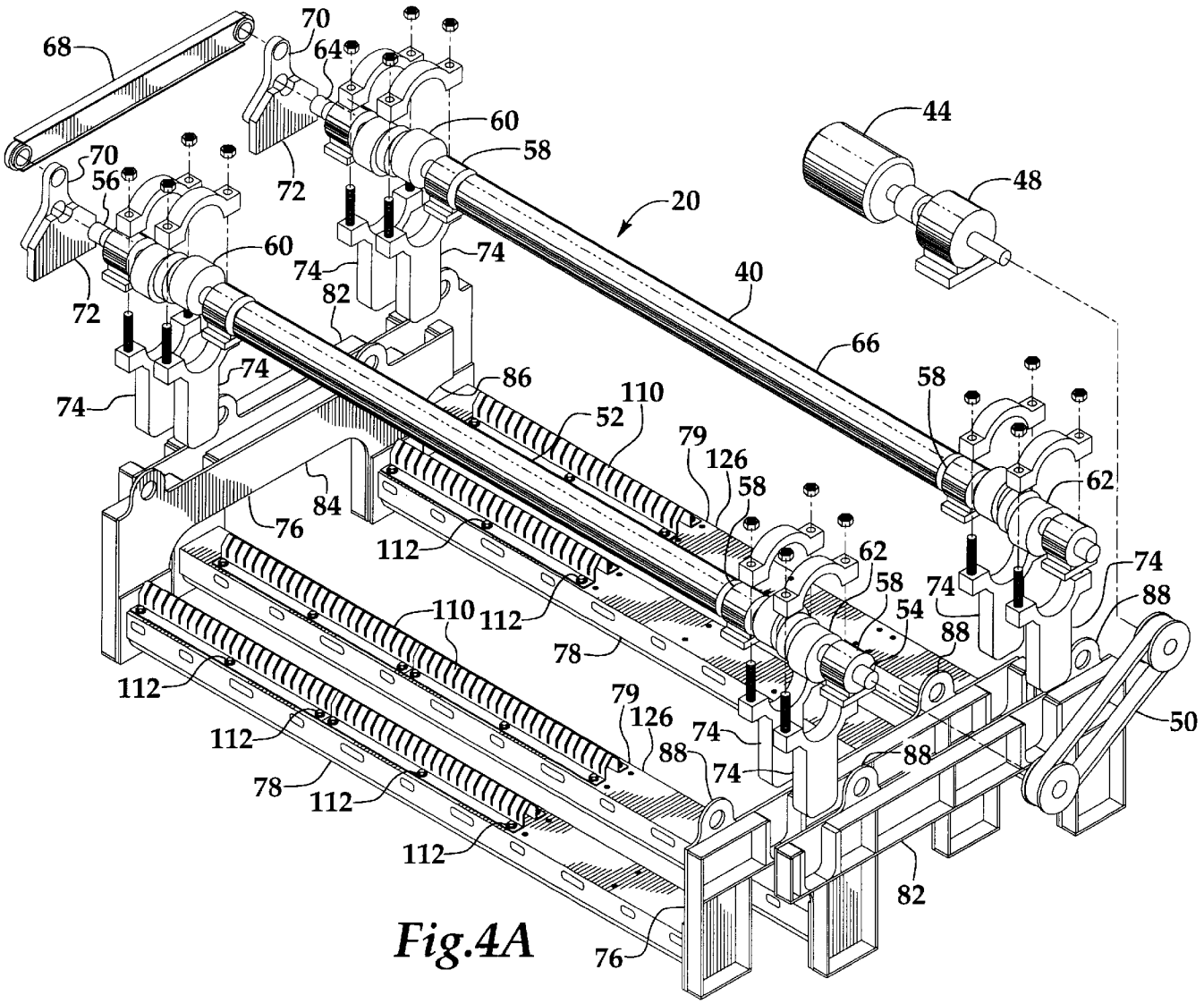
FIG. 4A is an exploded, isometric view of the drive train shown in FIG. 3.
Figure 4B:
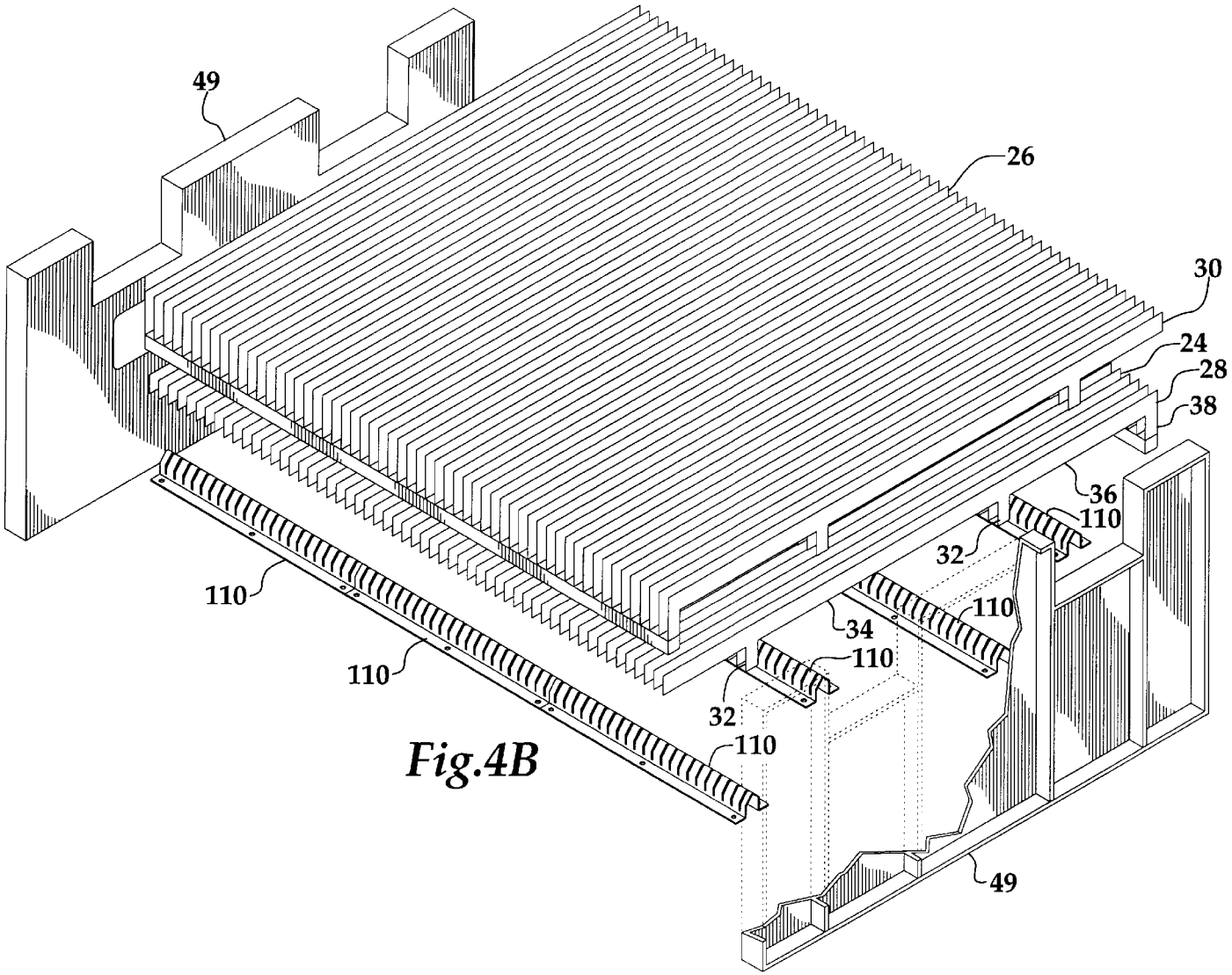
FIG. 4B is an exploded, isometric view of the screen deck and machine frame of the bar screen shown in FIG. 3.

Referring more particularly to FIGS. 1–19 wherein like numbers refer to similar parts, a bar screen 20 is shown in FIG. 1. The bar screen 20 has a screen deck 22 formed by a plurality of oscillating bars which define gaps 42 through which matter of a desired minimum size is screened. As shown in FIG. 4*b*, the deck 22 is composed of a first rack 24 and a second rack 26. The first rack 24 is composed of a first set of parallel bars 28 and the second rack 26 is composed of a second set of parallel bars 30. The bars 28, 30 of the first rack 24 and the second rack 26 are identical except for their orientation. As shown in FIGS. 2, 3, and 4A the bar screen 20 has a rigid frame 46 which supports a linked drive train 40 which through a cam mechanism oscillates an inner drive frames 76 and outer drive frames 82 which are connected to the bars 28, 30 to impart a desired vertical and machine direction motion to the racks 24, 26.

Each bar 28, 30 of each rack 24, 26 has an unbroken top surface and has two depending support legs 32. As shown in FIG. 4B, the bars 28, 30 have a supported section 34 between the two legs 32 and a cantilever section 36 which extends sidewardly from one of the legs. The cantilever sections 36 have downwardly extending short legs 38, which are shorter than the support legs 32 and which are held in fixed spaced relation to stabilize the cantilever sections 36 but are otherwise unsupported.

As shown in FIGS. 1, 2 AND 3, the parallel bars 28 of the first rack 24 interdigitate or interleave with the bars 30 of the second rack 26. A drive train 40, best shown in FIG. 3, and 4A causes the bars 28 of the first rack 24 to oscillate vertically and in the lengthwise direction of the bars. The drive train 40 also causes the bars 30 of the second rack 26 to oscillate in a similar fashion but 180 degrees out of phase or out of sync with the first rack. It is the oscillation of the bars 28, 30 of the first rack 24 and the second rack 26 together with a three degree slope of the screen deck 22 which causes the granular materials such as wood chips or municipal wastes to progress over the screen deck and for a portion of that granular material to pass through the screen deck.

In known bar screens, the bars of each rack have been mounted by their depending legs to support beams which ride on eccentric shafts. In such bar screens, the use of eccentric shafts inside the bar support beams has limited the practical width of the bar screen. As a bar screen is made wider, the eccentric shafts tend to deflect under the load imposed by the bar support beams which also deflect under the load of the bars and the material being sorted. The deflection of the eccentric beams can cause excessive wear on the eccentric shaft bearings.

The overhead drive train 40 overcomes these problems while at the same time moving all bearing surfaces out from under the screen deck. The bearing surfaces are thus subjected to less contamination by dirt and particulate matter and are more readily accessible for maintenance.

The drive train, best shown in FIGS. 3 and 4A, is driven by a drive motor 44 which is mounted by a mounting bracket (not shown for clarity) to the machine frame 46, best shown in FIGS. 1 and 2. The machine frame is preferably formed of two side weldments 49 which are connected by a tubular stiffening beam (not shown) across the bottom, and two overhead covered troughs 59.

The motor 44 drives a gear box 48 which in turn drives a belt 50. The belt 50 turns a first crank shaft 52. As shown in FIG. 1, the first crank shaft 52 extends across the width of the screen deck 22 perpendicular to the parallel bars. The first crank shaft 52 has a driven end 54 and a driving end 56 and is rotatably mounted to the machine frame 46 by shaft bearings 58. The bearings are supported on a frame trough 59 which shields the bearings form exposure to contaminants.

As shown in FIG. 4A, the first crank shaft 52 has an offset cam construction at both the driven end and the driving end. The first crankshaft 52 thus has outer cam surfaces 62 and inner cam surfaces 60. The cam surfaces 60, 62 are cylindrical, but the axis of each cylindrical surface is offset from the axis of the crank shaft 52 by about one inch and from the adjacent cam surface by about two inches. However, the outer cam surfaces 62 are coaxial with each other, and the inner cam surfaces 60 are coaxial with each other.

The first crank shaft 52 is supported on two shaft bearings 58 at the driving end and at the driven end. At each end of the shaft 52 shaft bearings 58 are on either side of a set of inner and outer cam surfaces. The driving end 56 of the first crank shaft 52 is linked to the driven end 64 of the second crank shaft 66 by a crank link 68 which extends between radially extending crank arms 70 which are fixed to the shaft ends 56, 64. The crank arms have counterweights 72 which balance the crank link 68.

The second crank shaft 66 is similar the first crank shaft 52 and extends parallel to the first crank shaft 52 across the screen bed 22 and is mounted to the machine frame 46 by pairs of shaft bearings 58 which are spaced about pairs of inner cam surfaces 60 and outer cam surfaces 62.

The first drive shaft 52 and the second drive shaft 66 are linked together so that the inner four cam surfaces 60 move in unison. Similarly, the outer four cam surfaces 62 move in unison 180 degrees out of sync with the inner cam surfaces 60. The cam surfaces 60, 62 support the drive frames 76, 82 and by imparting a circular motion to the drive frames cause the vertical and machine direction movement of the interleaved racks 24, 26.

The bars 28 of the first rack 24 are connected to two support beams 78 which connect two inner drive frames 76. The bars 30 of the second rack 26 are connected to two support beams 79 which extend between and connect two outer drive frames 82. The support beams 78, 79 extend generally parallel to the crank shafts 52, 66.

Figure 18:
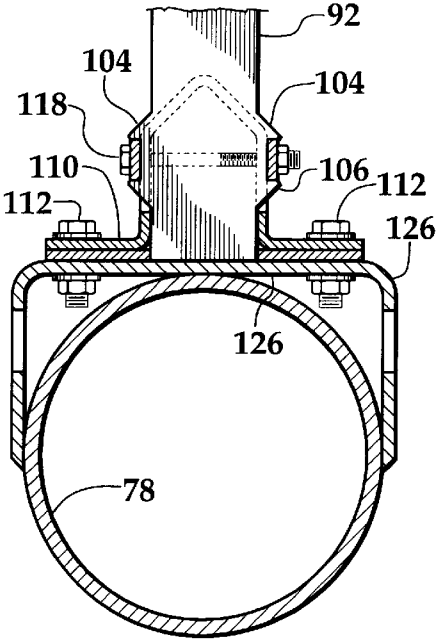
FIG. 18 is a cross-sectional view of the preferred bar mounting bracket employed in the bar screen of FIG. 1.

Each drive frame 76, 82 has two upwardly extending cam follower bearing assemblies 74 which connect each frame to cam surfaces on the first and second crank shafts. The inner drive frame cam followers 74 ride on the inner cam surfaces 60. Bar clamping brackets 110, shown in FIG. 18, are mounted to the support beams 78. The bar clamping brackets 110 are fixed to the support beams 78 and support the first set of parallel bars 28 which form the first rack 24.

The outer drive frames 82 are bolted to cam followers 74 which ride on the outer cam surfaces 62 on the crank shafts 52, 66. The inner drive frames 76 have cutouts 84 and 86 which allow the bar support beams 79 of the outer drive frames 82 to pass through the inner drive frames 76. Thus the inner drive frames 76 and the outer drive frames 82 oscillate 180 degrees out of phase without interference between the drive frames 76, 82 or the bar support beams 78, 79.

The bar screen drive mechanism 40 is dynamically balanced as the first rack 24 and the second rack 26 are of equal weights and are driven 180 degrees out of phase. Hence, when the first rack 24 mounted on the first support beams 76 is being moved upwardly by the drive frames 76 which are driven by the cam followers on the inner cam surfaces, the second rack is 26 mounted on the second support beams 79 is being moved downwardly by the outer drive frames 82 in engagement with the cam followers 74 on the outer cam surfaces 62.

Because the cam surfaces 60, 62 which support the bar racks are closely supported by bearings 58, relatively little deflection of the cam surfaces takes place. Thus, the width of this bar screen deck 22 can be made considerably wider before a deflection of the shafts 52, 66 becomes a concern. Further, all of the bearings 74, 58 are located above the screen deck 22 and thus are not subjected to a constant rain of dirt and debris which bearings located under the screen deck are subjected to. Additionally, the location of the bearings makes them readily accessible for what maintenance is required.

Another advantage of the drive train 40 over previous drive mechanisms for bar screens is that the two racks of bars which form the screen deck 22 directly mechanically linked, assuring that the phase relationship between the oscillating racks of bars remains fixed. All of the mechanical linkages between the inner and outer drive frames are designed to transmit the entire load which the motor can impose through the drive train. Thus, if any component of the system jams, the entire machine stops with the result that the drive belt 50 slips or the motor 44 stalls. The halting of the machine prevents any serious damage to the overall machine. When the jam is cleared, the entire drive train remains in alignment so that the bars comprising the screen deck remain in their precisely 180-degree-out-of-phase oscillatory motion.

Because the drive train 40 on the bar screen 20 employs a single motor 44, problems of overloading one motor with respect to another or having two motors working against each other are eliminated.

The inner drive frame 76 and the outer drive frame 82 perform an additional beneficial function in addition to driving the bar support beams 78 and 79 in oscillatory motion. The inner drive frames 76 tie the inner bar support beams 78 together structurally. Similarly, the outer drive support frames 82 tie the outer bar support beams together structurally. Thus, the screen bars 28, 30 are not required to perform structural functions required in conventional bar screens of tying together the bar support beams or shafts. Because the bars 28, 30 do not perform the structural function, they may be of thinner gauge. Whereas conventional bar screens typically have screening bars of half an inch or greater in thickness, bar screens having widths of only a quarter of an inch or less are entirely practical. Thus, for a given bar screen deck area, the use of thinner bars allows more bars to be used and consequently more space between bars. It is the space between bars or the open area of the screen deck 22 which in general governs the rate at which material can be sorted by a given bar screen.

As illustrated in FIG. 4A, and 4B the bar screen 20 may be readily disassembled to facilitate maintenance. Crane attachment points 88 are mounted on the drive frames 76, 82 and facilitate separation of the bar screen racks 24, 26 when bar maintenance is required.

Figure 8:
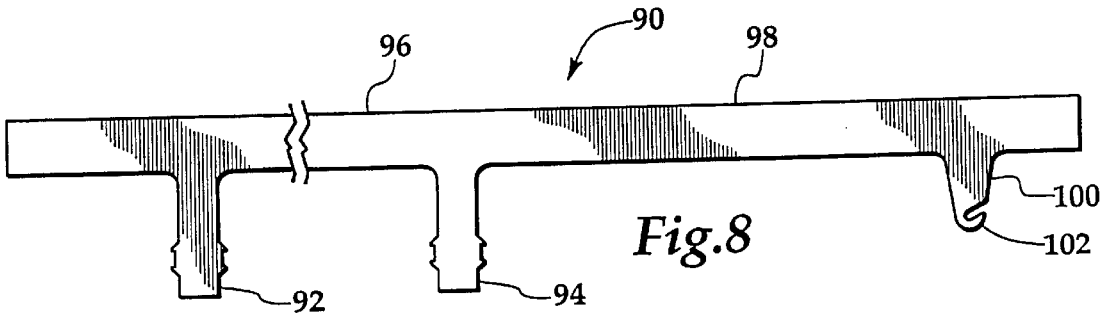
FIG. 8 is a side-elevational view of a bar which may be employed in the bar screen of FIG. 1.
Figure 12:
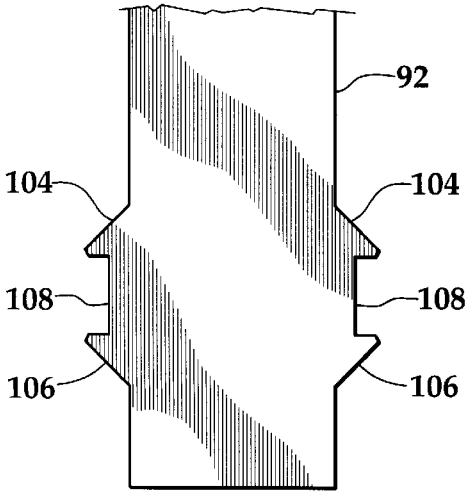
FIG. 12 is a side-elevational view of the preferred depending leg employed in the bar screen of FIG. 1.
Figure 13:
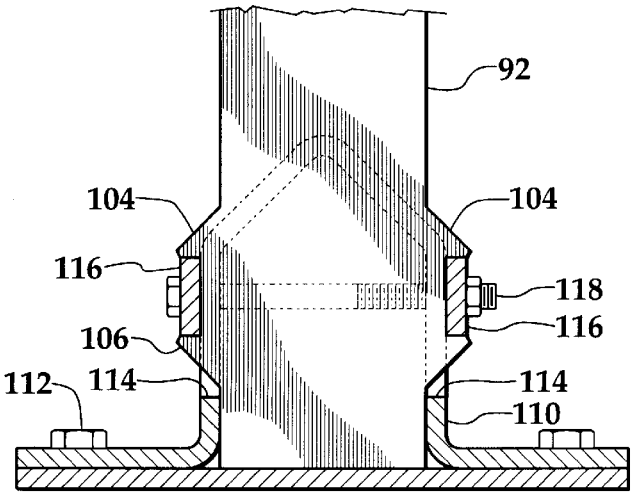
FIG. 13 is a cross-sectional view of the preferred bar mounting bracket employed in the bar screen of FIG. 1.

An alternative screening bar 90 for use in the bar screen 20 is shown in FIG. 8, which may be employed where thin gauge bars are required. As shown in FIGS. 12, 13, 18 and 19, the bars 90 are supported for oscillating motion by bar retention brackets 110 which are bolted to a bar support beam 78. The bar 90 has depending legs 92 and 94 for engagement by the retention bracket 110. A central supported section 96 extends between the legs 92, 94. A cantilevered section 98 extends horizontally from the supported section 96 and extends beyond one leg 94. The cantilevered section 98 has a downwardly depending cantilever leg 100 which has an upwardly opening canted slot 102. As shown in FIG. 12, each bar leg 92, 94 has two upper projections 104 and two lower projections 106. A rectangular slot 108 is defined between the upper and lower projections 104, 106 on each side of the leg. The legs 92, 94 are too thin to allow a bolt to extend lengthwise therethrough as in conventional thicker screen bars.

All the bars 90 within a single rack are positioned within parallel slots 114 in the retention bracket 110. A rectangular clamping bars 116 runs the length of the retention bracket 110 and engages within the rectangular slots 108 on one side of the bar leg 92. A second clamping bar 116 is positioned on the opposite side of the bar leg 92 and is clamped to the first clamping bar with the retention bracket 110 therebetween by bolts 118. The bar retention bracket 110 is bolted by bolts 112 to a bar support beam 78. The bar 116 extends across twenty-two slots 114. The upper and lower projections 104, 106 lock the legs 92 to the bars 116, thereby fixing the legs 92 to the bracket 110 and to the bar support beam 78.

Figure 10:
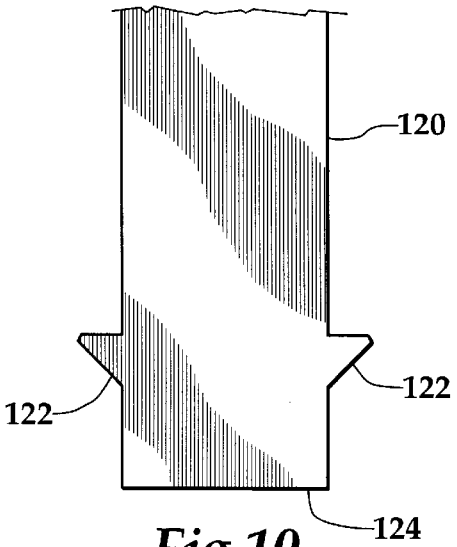
FIG. 10 shows an alternative embodiment of the depending leg employed on the bars of the bar screen of FIG. 1.
Figure 11:
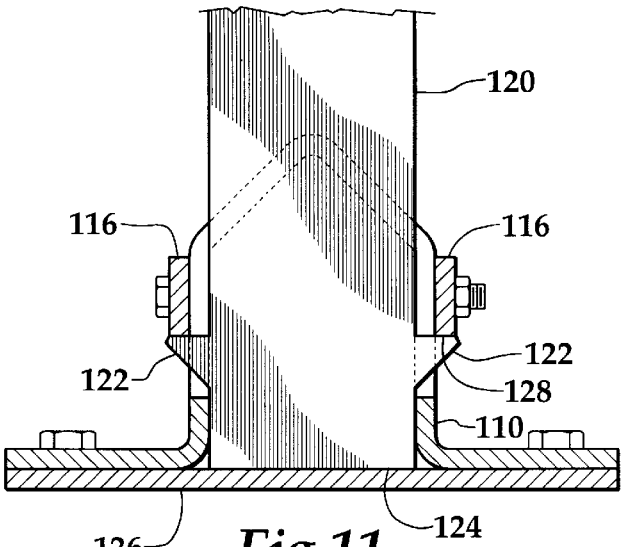
FIG. 11 is a cross-sectional view of the clamping bracket which mounts the depending leg of FIG. 12.

An alternative bar leg 120, shown in FIG. 10, has only lower projections 122. Because the bottom 124 of the bar 120 is restrained by the top plate 126 of the bar support beam 78, the upper projections 104 of the bar leg 92 are not required to positively lock the leg 120 in place. As shown in FIG. 11, the leg 120 is held in place between the bottom edges 128 of the bars 116 and the bottom plate 126.

Figure 9:
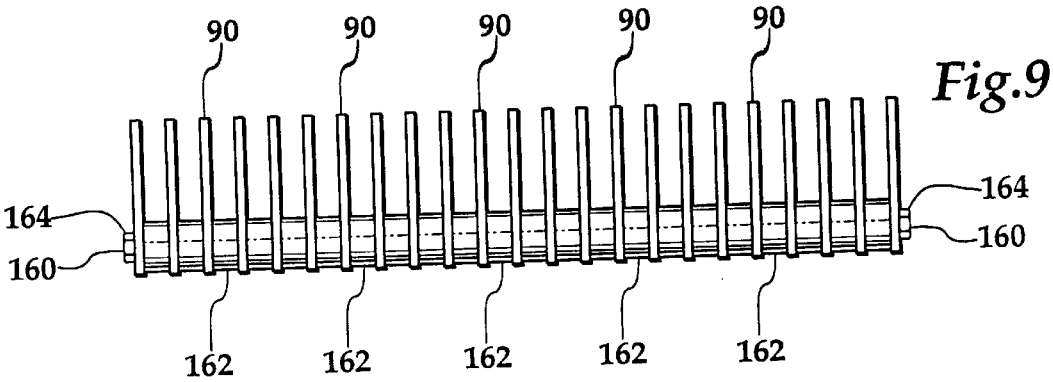
FIG. 9 is a front-elevational view of a threaded rod with resilient spacers which engages a plurality of bars of FIG. 10.

As shown in FIG. 8, each screening bar 90 has a cantilevered section 98 which has a short cantilever leg 100. It has been found advantageous to prevent the lateral deflection of the cantilevered section 98 by joining the cantilever legs 100 together by means of a threaded rod 160 which extends through spacers 162 of polyurethane or other resilient material as shown in FIG. 9. The canted slots 102, shown in FIG. 8, allow the plastic spacers 162 to be positioned on the threaded rod 160 and the threaded rod to pass into the slots 102 in the cantilever legs 100. When nuts 164 at the end of the rod 160 are tightened, the bars 90 and the intervening spacers 162 are clamped together.

Figure 7:
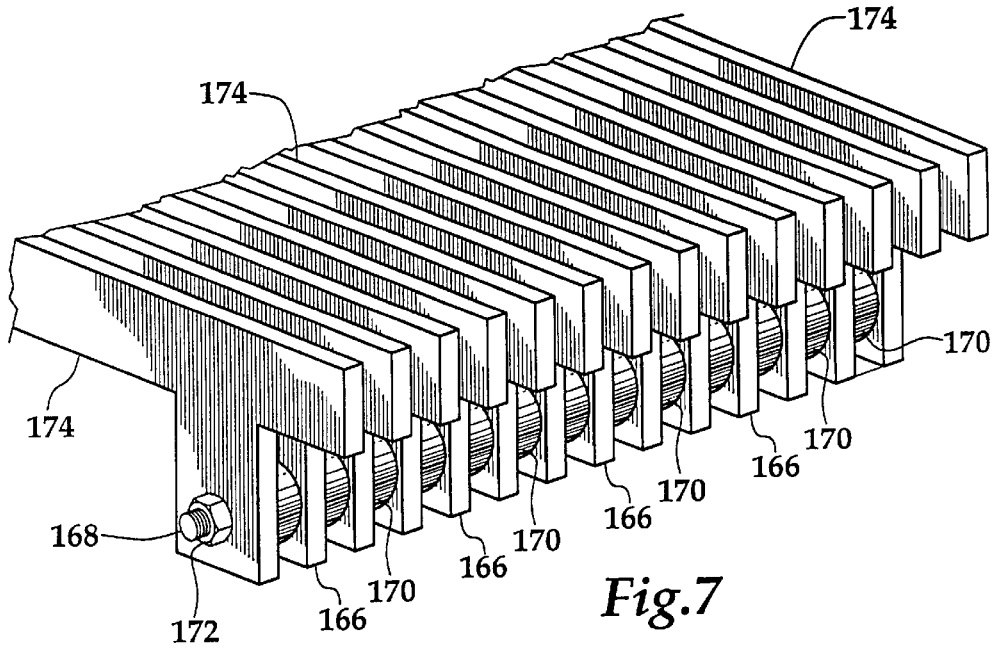
FIG. 7 is an isometric view of another bar joining system.

FIG. 7 shows an alternative embodiment wherein the end cantilever legs 166 have holes (not shown) through which a threaded rod 168 passes. The threaded rod positions plastic polyurethane spacers 170 between the cantilever legs 166. When the nuts 172 are tightened, the bars 174 of FIG. 7 are held spaced apart in clamped engagement with the plastic spacers 170.

Figure 5:
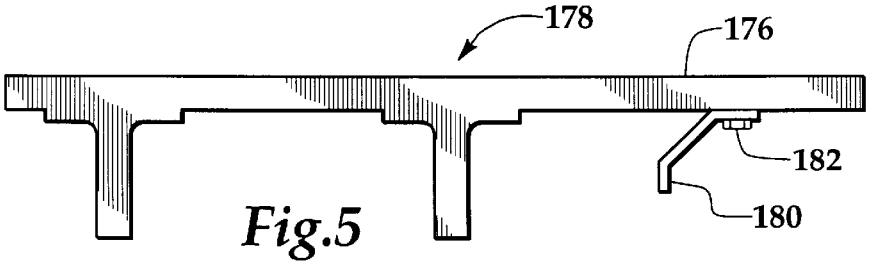
Fig.5 (PRIOR ART)
FIG. 5 is a prior art structure for joining together the bars of a rack.

FIG. 5 shows a prior art method of holding the cantilever section 176 of a conventional bar 178. A stiffening flange 180 is bolted by bolts 182 to the bottom of each bar. This prior art bar support method has been plagued with breakage problems in the past.

Figure 6:
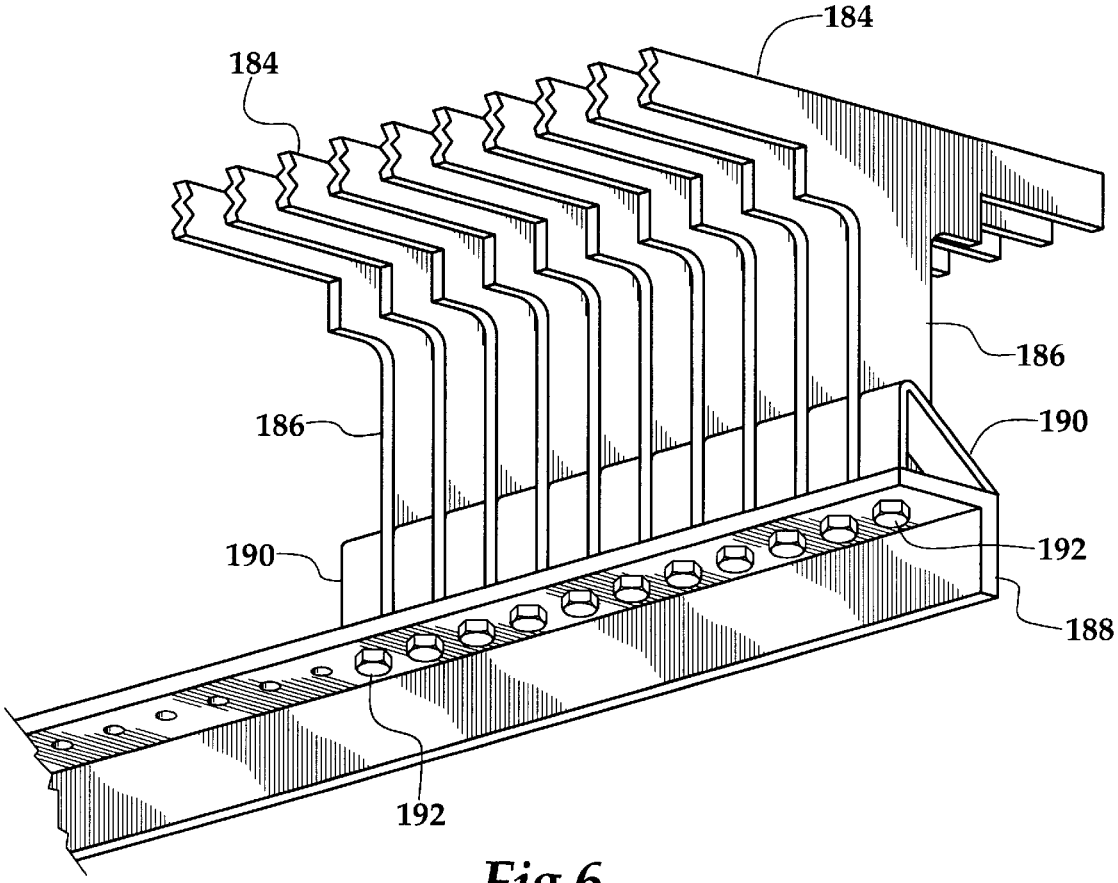
FIG. 6 is an isometric view of an improved bar joining bracket.

An improved design illustrated in FIG. 6 utilizes bars 184 which have depending cantilever legs 186. The legs 186 are bolted to a flange 188 to which is welded to a slotted spacer 190. The bolts 192 extend into the bottoms of the legs 186. The spacer 190 prevents bending of the legs 186 with respect to the stiffening flange 188 thus preventing cracking and fatigue of the bolts 192 or the legs 186 where they join the stiffening flange 188.

Figure 17:
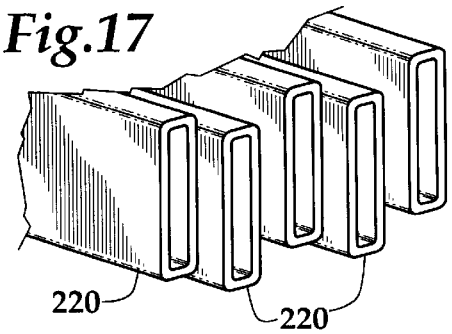
FIG. 17 is a cross-sectional view of an alternative embodiment of the bars employed in the bar screen of FIG. 1 wherein the bars are formed of hollow tubes.

Alternative hollow screen bars 220 are shown in FIG. 17. The bars 220 may be fabricated of stainless steel or other corrosion resistant materials. By forming the bars 220, by flattening tubular stock, bars of lightweight construction yet of considerable strength are formed. Further, because of the lower weight of material, and higher costs, more corrosion resistant material may be used, thus eliminating the need to coat the bars 220 with a corrosion resistant coating.

Figure 14:
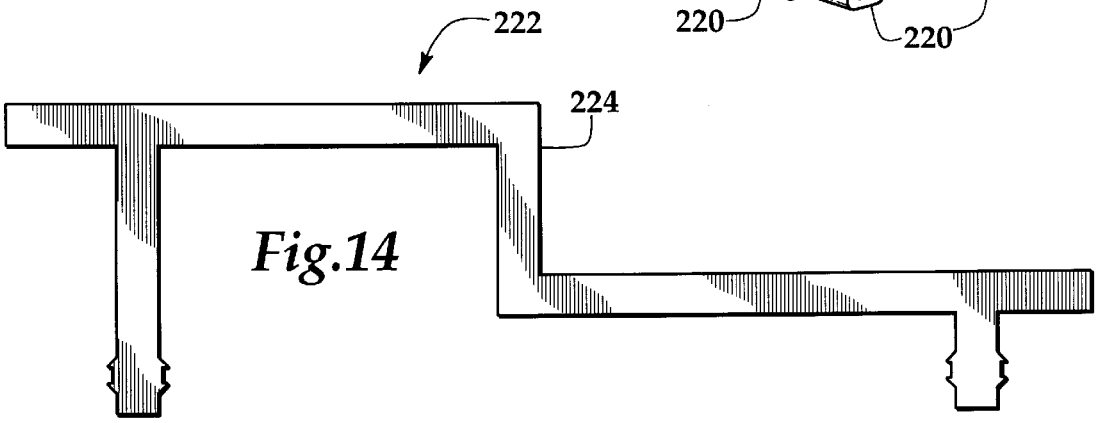
FIG. 14 is a side-elevational view of a stepped bar which may be employed in the bar screen of FIG. 1.

An alternative screen bar 222, shown in FIG. 14, has a step 224. Bar screens have been found useful for processing office paper waste. This material consists of recycled paper collected from commercial offices and is normally contaminated by cigarette butts, paper clips and other dirt and debris. Bar screens have proven effective at separating this debris from the paper sheets to be reprocessed. However, a certain amount of debris becomes trapped on the upper surface of the waste paper as it travels over the bars. Thus, a bar screen 222 with a step 224 causes the office paper to cascade down the step, flipping over in the transition, and thereby dislodging the particulate waste from the upper surface where it may pass through the gaps between bars 222.

Figure 15:
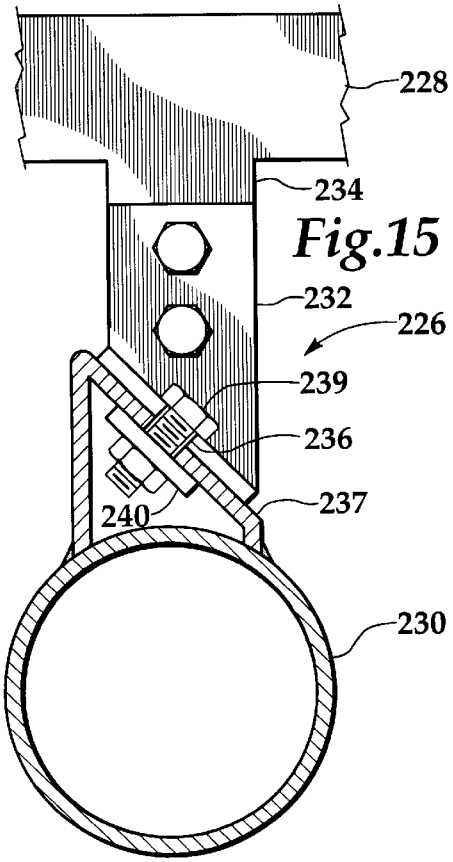
FIG. 15 is a side-elevational view of a yet further bar screen clamp.
Figure 16:
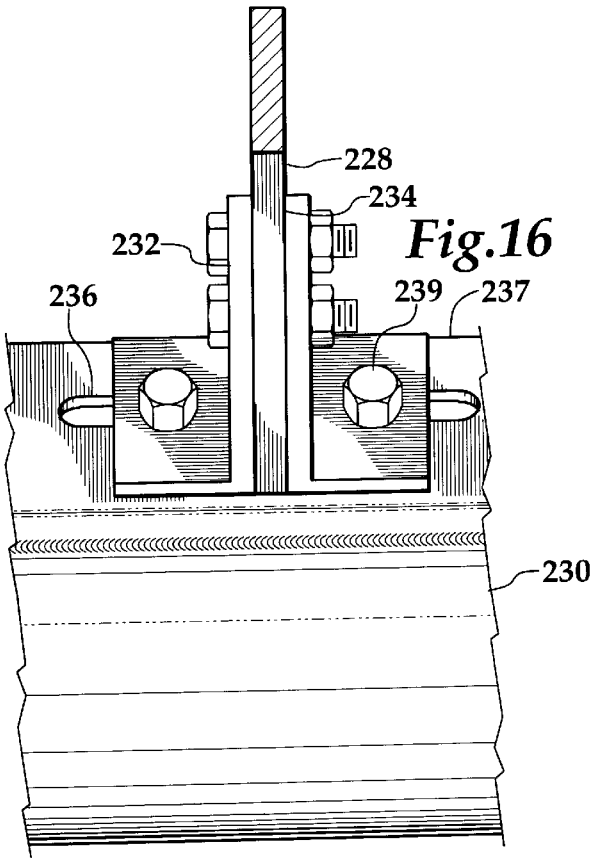
FIG. 16 is a front-elevational view of the leg clamp of FIG. 23.
Figure 19:
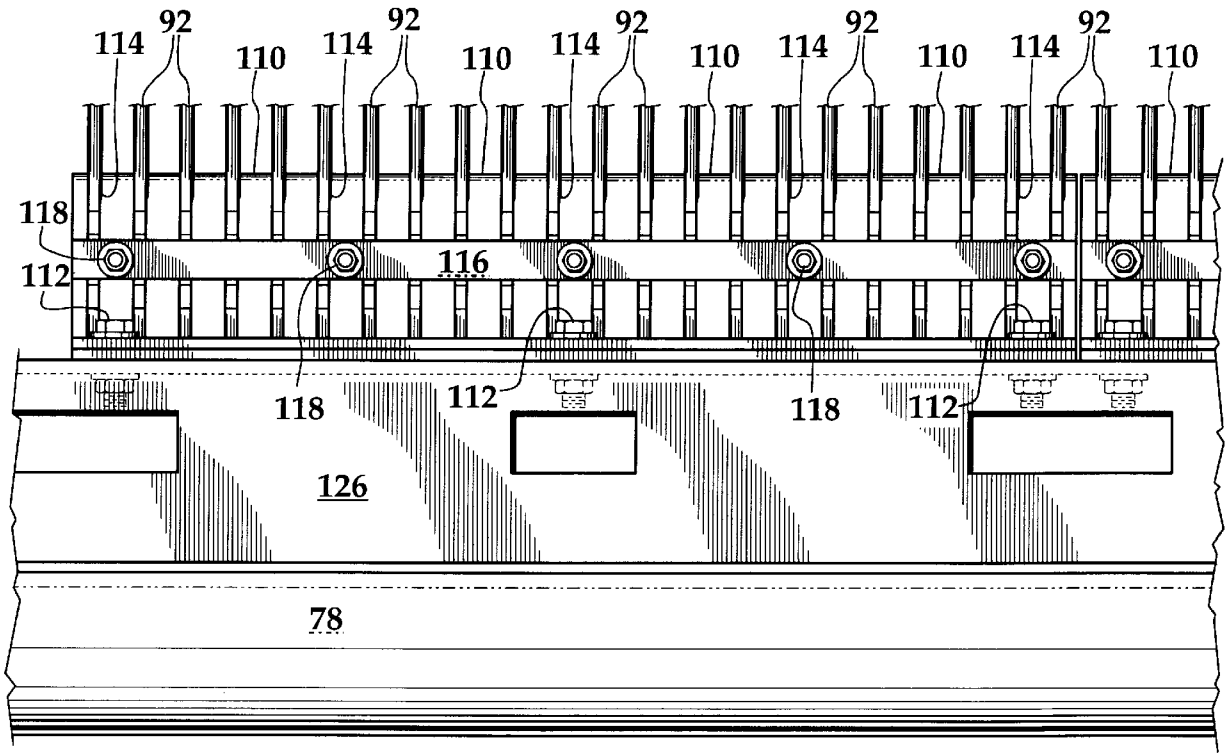
FIG. 19 is a side-elevational view of the preferred bar mounting bracket employed in the bar screen of FIG. 1.

FIGS. 15 and 16 illustrate a clamping mechanism 226 which allows the adjustable positioning of thicker bars 228 to a bar support beam 230. The bracket consists of two bookend flanges 232 which are bolted to the downward depending legs 234 of the bars 228. The bookend flanges are in turn bolted in a slot 236 of an angled bracket 237 which is welded to the bar support beam 230. The bookend bolts 239 clamp retention plates 240 against the bracket 237 to lock the bookends 232 and thus the screen bars 228 to the bar support beam 230 which supports and drives the bars 228 in an oscillatory motion.

It is understood that the invention is not limited to the particular construction and arrangement of parts herein illustrated and described, but embraces such modified forms thereof as come within the scope of the following claims.

We claim:

1. A bar screen for screening wood chips or waste; comprising:

a machine frame;

a first set of parallel bars which define a first rack;

a second set of parallel bars which define a second rack, wherein the bars of the first rack are interleaved with the bars of the second rack, and wherein screening gaps are defined between adjacent interleaved bars;

at least two crank shafts rotatably mounted to the machine frame and positioned above the first and second racks, two first drive frames which are mounted to the crank shafts in opposed relation, two first bar support beams which extend between and connect the two first drive frames, wherein the first set of parallel bars is mounted to the two first bar support beams;

two second drive frames which are mounted to the crank shafts in opposed relation;

two second bar support beams which extend between and connect the two second drive frames, wherein the second set of parallel bars is mounted to the two second support beams, and wherein the first and second drive frames are driven by the crank shafts to impart oscillatory motion to the racks.

2. The apparatus of claim 1 wherein the first frames are spaced outwardly of the second frames and the first bar support beams are offset in spaced parallel relation to the second bar support beams.

3. The apparatus of claim 1 wherein each crank shaft has formed thereon two pairs of axially spaced inner and outer cam surfaces, and wherein the first frames are supported on the outer cam surfaces and the second frames are supported on the inner cam surfaces.

4. The apparatus of claim 3 wherein each cam surface is a right conic surface which has an axis which is offset from the axis of the crank shaft on which the surface is formed.

5. The apparatus of claim 4 wherein each pair of cam surfaces are offset from one another about the axis of the crank shaft by 180 degrees.

6. The apparatus of claim 1 wherein the two crank shafts comprise a first crank shaft and a second crank shaft and wherein the first crank shaft is driven from a motor and is joined in driving relation to the second crank shaft by at least one crank arm and a link so all the moving parts of the drive train are joined by mechanical linkages.

7. A bar screen for screening wood chips or waste; comprising:

a machine frame;

a first set of parallel bars which define a first rack;

a second set of parallel bars which define a second rack, wherein the bars of the first rack are interleaved with the bars of the second rack, and wherein screening gaps are defined between adjacent interleaved bars;

a means for causing reciprocating motion positioned above the first and second racks, two first drive frames which are mounted to the means for causing reciprocating motion, the frames being in opposed relation, two bar support beams which extend between and connect the two first drive frames, wherein the first set of parallel bars is mounted to the two mounting beams;

two second drive frames which are mounted to the means for causing reciprocating motion, the frames being in opposed relation;

two bar support beams which extend between and connect the two second drive frames, wherein the second set of parallel bars is mounted to said two support beams, and wherein the first and second drive frames are driven by the means for causing reciprocating motion to impart oscillatory motion to the racks.

* * * * *